US006752568B1

(12) United States Patent
Stone

(10) Patent No.: US 6,752,568 B1
(45) Date of Patent: Jun. 22, 2004

(54) DEVICE FOR PLACEMENT OF TEMPORARY PAVEMENT MARKERS

(76) Inventor: Mary Anna Jane Stone, 15 Beven Rd., Garden Valley, ID (US) 83622

( * ) Notice: Subject to any disclaimer, the term of this patent is extended or adjusted under 35 U.S.C. 154(b) by 0 days.

(21) Appl. No.: 10/322,393

(22) Filed: Dec. 17, 2002

(51) Int. Cl.[7] ..... E01C 19/52
(52) U.S. Cl. ..... 404/99
(58) Field of Search ..... 404/93, 94, 99, 404/100

(56) References Cited

U.S. PATENT DOCUMENTS

| | | | | | |
|---|---|---|---|---|---|
| 2,875,675 | A | | 3/1959 | Searight | |
| 3,086,431 | A | * | 4/1963 | Perry, Jr. | 404/94 |
| 3,844,669 | A | | 10/1974 | Eigenmann | |
| 3,864,052 | A | | 2/1975 | Blomberg | |
| 4,089,730 | A | * | 5/1978 | Mahn | 156/541 |
| 4,145,152 | A | | 3/1979 | Waugh | |
| 4,623,280 | A | | 11/1986 | Stenemann | |
| 4,792,259 | A | * | 12/1988 | Eigenmann | 404/73 |
| 4,797,025 | A | | 1/1989 | Kennedy et al. | |
| 4,974,990 | A | | 12/1990 | Anderson et al. | |
| 5,213,464 | A | * | 5/1993 | Nicholson et al. | 414/400 |
| 5,391,015 | A | | 2/1995 | Kaczmarczik et al. | |
| 5,421,669 | A | | 6/1995 | Bertrand | |
| 5,439,312 | A | * | 8/1995 | Marcato | 404/12 |
| 5,772,359 | A | | 6/1998 | Marty | |
| 5,785,453 | A | | 7/1998 | Marty et al. | |
| 5,865,943 | A | | 2/1999 | Marty | |
| 5,934,822 | A | | 8/1999 | Green | |
| 6,247,872 | B1 | * | 6/2001 | Marcato | 404/94 |

* cited by examiner

*Primary Examiner*—Gary S. Hartmann
(74) *Attorney, Agent, or Firm*—Derek H. Maughan; Frank J. Dykas; Dykas, Shaver & Nipper

(57) ABSTRACT

A device for placing individual road markers in desired configurations along a road surface comprises an application wheel having at least one aperture connected to a frame by an axle. The frame and application wheel are then connected to a trailer that is pulled along behind a pulling device. The apertures of the application wheel are dimensioned to receive a part of the road marker in a position tangential to the surface of the application wheel. As the application wheel rolls over the surface, the base portion of the marker contacts the road surface. An adhesive portion of the marker causes the base of the marker to become adhered to the road surface. As the application wheel continues to roll, the standing reflective portion of the marker is withdrawn from its position within aperture of the application wheel, and remains in a desired location upon the road surface.

10 Claims, 7 Drawing Sheets

DEVICE FOR PLACEMENT OF TEMPORARY PAVEMENT MARKERS

BACKGROUND OF THE INVENTION

1. Field of the Invention

The present invention generally relates to a device for placing temporary pavement markers used as short-term temporary road markers during road resurfacing, and more particularly relates to a device for placing temporary pavement markers in a desired location from a moving vehicle.

2. Background Information

Periodic road maintenance normally includes pavement resurfacing using either a chip, slurry, or road seal compound that is applied over the original surface in order to restore and protect it. When this is done, the existing painted traffic lines, be they centerlines, passing lines, no passing lines, turn lane lines, or any other traffic painted line will be covered and thereby obliterated and no longer visible.

In order to preserve the accurate location and type designation of these lines, temporary pavement markers are first installed on the road surface prior to any road coating operation. These temporary pavement markers are typically formed of a resilient plastic material and have a base portion and an upwardly extending standing reflective portion that will extend up through each and every layer of coating applied to the road surface during the resurfacing operation. Typically, the base portion of the marker has affixed to it an adhesive that holds the temporary pavement marker to the road. The material from which temporary pavement markers are made is not intended to withstand permanent road traffic conditions, and will either be manually torn off, break off because of weather exposure, or will be pulverized by traffic on the resurfaced road. However, they are designed to last long enough for the entire resurfacing project to be completed, and up to and including the repainting of the various traffic lines upon the new surface.

Placement of these temporary pavement markers are usually done either manually, where they are set in position by someone walking along the road and placing them on a surface, or they are put in place by some type of mechanical apparatus, which may be towed or driven along the road. The placement of these devices along the roadway requires that the adhesive flat backing portion be activated so as to allow the marker to interact with the surface of the road upon which it is placed. These pavement markers must also be placed in correct locations so as to provide for safe operation of motor vehicles in roads that are under construction. This requires that the placement of these reflective devices is done in a way that is both quick and precise.

For purposes of illustration in this specification, a chip sealing operation will be described, including the three stages thereof so as to fully understand the prior art and present invention. FIG. 1 shows a typical temporary road pavement marker. These markers have a base portion to which an adhesive is applied, and an upwardly extending standing portion that has one or more reflectors attached thereto. For convenience this portion will be referred to as the standing portion throughout the specification. Covering the reflective standing portion of the temporary marker are layers of clear protective covers. The purpose of these clear protective covers is to enable the maintenance crew to renew the reflective properties of the temporary road marker between the various coatings that are applied to the road during the chip sealing operation.

In practice a crew of laborers, prior to any chip sealing work, lays down temporary pavement markers over the top of the existing traffic lines. These markers signal the location of the traffic lines and are necessary both for safety reasons as well as to designate the location for permanent road marker placement which will be placed after the road resurfacing operation is completed. After the markers are placed, the remainder of the chip seal operation can continue. Typically, this would include a coating of oil being applied to the pavement which will coat the pavement and the reflective surfaces of the temporary road marker. This is followed by the deposit and compaction of a layer of chips or gravel, which would seal to the original surface through the base coat of oil. After this has been done the reflective portions of the markers are often covered with this mixture of oil, rock chips and gravel. In order for the reflective portions of the road marker to be seen, one of the protective covers is removed and the reflective portions of the marker are then visible. After the rock chips are deposited and compacted, a third sealing coat of oil may be applied to the road surface. In as much as this step would again cover the reflective standing portion of the device, another protective covering must be removed in order to reveal the reflective standing portion of the road marker.

After this is done a paint truck will follow along the road and repaint the lines using the temporary markers as a guide for the type and position of the lines to be painted. If markers have come loose or are placed inappropriately, it is possible that the road could be marked incorrectly thus resulting in a dangerous situation for drivers on the road.

Typically, placement of the road markers is done in a coded fashion to indicate the existence of solid and broken traffic lines, turn lanes, and fog lines. As discussed previously, this placement must be done both quickly and correctly. Misplaced markers can result in traffic accidents and misplaced permanent traffic indicators. Since the markers must be placed both correctly and quickly, a variety of prior art means have been developed.

The prior art describes both manual placement of these temporary marking devices, which is very time consuming, as well as automated placement devices which allow the markers to be placed more quickly. In the manual method, an adhesive is placed upon the base portion of the marker, or a preexisting portion of the base marker is exposed and the marker is placed manually in a desired location upon the road surface. Usually the persons who place these markers either walk or drive from location to location. When these persons arrive at a desired location they stop, apply an adhesive and place the base portion of the marker upon the road. This process is both time consuming and labor intensive.

Some automated devices also exist which place pavement markers in desired locations. Most of these devices have a feeder means which feed markers into a position for placement, an adhesive means is then either placed upon the roadway or the base of the marker and the marker is placed upon the road surface. One significant drawback to most of these pieces of machinery is cost. Many of these pieces of machinery, while useful, are also expensive and therefore inaccessible by a variety of smaller companies. Another drawback of many of these automated devices is that they lack the ability to place marks in complicated patterns or to account for other modifications in road surfaces or traffic pattern layout.

Accordingly, what is needed is a device for placing temporary pavement markers on road surfaces that allows these markers to be placed quickly and correctly in proper locations. Another object of the present invention is to provide a device for placing road markers upon a road surface which is economically accessible to a greater variety of persons than present devices. Another object of the invention is to provide a device for placing road markers which can be used in conjunction with a motorized vehicle to place road markers in desired locations in a way that is quicker than manual placement and more accurate than traditional prior art mechanical placement devices. Another object of the invention is to provide a device for placement of temporary road marker in complex patterns that is more efficient than placing such markers manually.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The invention is a device for placing individual road markers in desired configurations along a road surface. Each of the road markers to be placed has a base portion (preferably with an adhesive surface) and an upright standing portion which is usually covered with a reflective marker or coating. In its simplest form, the invention comprises a application wheel having at least one aperture connected to a frame by an axle. This frame is then moved by a moving means which rolls the application wheel across a road surface.

The apertures of the application wheel are dimensioned to receive all or part of the standing reflective portion of the road marker therein. When the standing reflective portion of the road marker is inserted within the aperture, the base portion of the road marker is oriented tangential to the surface of the application wheel. In this position, an adhesive can be placed upon the base portion of the application wheel or the adhesive portion of the base can be exposed. It is also to be understood that the adhesive may be applied or exposed prior to placing the marker within the application wheel. Once the marker is in a desired position within the wheel, the application wheel can then be rolled over a surface. As the application wheel rolls over the surface, the base portion of the marker contacts the road surface. The adhesive portion of the marker causes the base of the marker to become adhered to the road surface. As the application wheel continues to roll, the standing reflective portion of the marker is withdrawn from its position within aperture of the application wheel, and remains in a desired location upon the road surface.

The placement of the marker upon the road surface is further facilitated by a compression means such as a subsequent wheel or other device which passes over the marker after the marker has been applied and compresses the marker into the road surface. This compression helps the adhesive to contact the road surface more fully and assists to maintain the marker in a desired location.

In various embodiments, additional means may be employed to control a variety of factors relating to the application and compression wheels, for example the rotation of the application wheel, the size of the apertures, the placement of the markers or the attachment means for connecting the frame of the application wheel to a moving means may all be variously configured to achieve the desired results.

In one embodiment of the invention, the application wheel and frame are connected to a pull-along type trailer. The trailer is made up of a hitch that is configured to connect to a pulling means such as an all-terrain vehicle or other motorized vehicle. The hitch is connected to a platform which is supported upon rolling wheels. One side of the platform has an adjustment bracket and a pivot axle which hold the frame containing the application wheel and the compression wheel in a desired position. One of the support wheels which support the platform may be configured for placement behind the application wheel so as to act as a compression wheel to the markers placed by the application wheel. This wheel supports the platform, and can also act as a secondary compression wheel to further compress the placed marker into the road surface.

The frame and application wheel are adjustably connected to one side of the platform by an adjustable connection bracket and by a pivot rod. The position of the frame and application wheel are controlled through a release lever that is connected both to the platform and to the application wheel frame. The release lever is configured to control the movement of the application wheel from a loading position where the application wheel is not in contact with a road surface to an application position where the application wheel is in contact with the road surface. A catch latch is configured to interact with a portion of the application wheel and holds the application wheel in a position for loading markers into the apertures. The top of the platform has a seatback and a storage rack configured to respectively support the user and provide a storage rack for markers to be used with the device. Other materials and features such as a shield may also be added the platform or other parts of the trailer in order to assist the user of the device.

In use, the user of the device is seated upon the platform behind the storage rack with their back against the seatback. The application wheel and frame are held in the loading position wherein the application wheel is not in contact with the road surface. The hitch of the platform is connected to the pulling means that is pulling the device forward at a desired rate of speed. The user is seated next to the application wheel and frame. The user places a road marker into the slot of the application wheel and prepares the adhesive portion of the base. If so desired the user may also prepare the adhesive portion of the base prior to placing the marker within the slot of the application wheel. Upon finding the location where the marker is to be placed, the user activates the lever to lower the application wheel into contact with the road surface and activates the catch release allowing the application wheel to rotate. The application wheel then rotates to place the wheel upon the road surface in the desired position. Upon contacting the road surface the adhesive of the marker base contacts and adheres to the road surface. The standing reflective portion of the marker then removes itself from within the application wheel and the application wheel continues to roll. After the marker has been placed, the user can then raise the application wheel back to the loading position and place another marker into the device. In some embodiments, this process is facilitated by the catch release re-engaging the application wheel and preventing further rotation of the application wheel beyond a position where the apertures are accessible to the user for marker insertion.

After the marker has been placed, a compression wheel runs over the marker to compress the marker into the road surface, and to further adhere the base of the marker to the road surface. In some embodiments, the compression wheel may be a second wheel placed in a frame and configured to follow the application wheel. In other embodiments the compression may be achieved by one of the support wheels of the trailer rolling over the marker and further compressing the marker into the road surface. Depending upon the necessities of the user or the application a variety of a number of compression means may be utilized.

Since the speed at which the vehicle pulling the device can be varied, and the placement of the markers is done manually, this device enables persons to place complex patterns in a manner that is more rapid and precise than existing prior art methods and devices. This device thus provides a method and device for placing temporary road markers upon a surface to be paved in a way that can be done in a way that can be done more quickly and at a lower cost than methods currently known in the prior art. This device also enables a user to place temporary pavement markers on road surfaces quickly and correctly in proper locations. The present invention also provides a device which is economically accessible to a greater variety of persons than present devices. The present invention also provides a device which can be used in conjunction with a motorized vehicle to place road markers in desired locations in a way that is quicker than manual placement and more accurate than traditional prior art mechanical placement devices. The present invention for placement of temporary road markers in complex patterns is more efficient than placing such markers manually.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
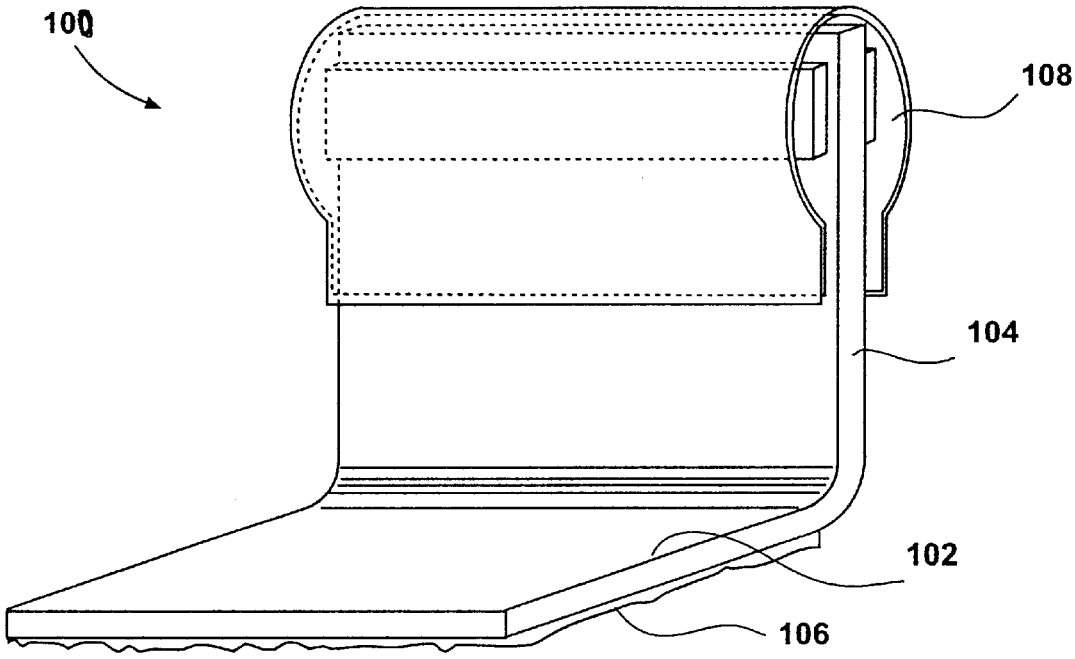
PRIOR ART Fig. 1
FIG. 1 is a perspective representational view of a typical temporary pavement marker having a flat base portion and an upright standing reflective portion.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention shown in FIGS. 2–5 is a device for placing road markers in desired locations along a road surface. As shown in FIG. 1, a typical road marker 100 is made up of a base portion 102 connected to an upright standing portion 104. The upright portion 104 is typically covered with at least one reflective marker 108 or a reflective material so as to make the marker 100 reflective and more visible. The reflective portion 108 may be covered with layers of generally clear adhesive coverings which can be removed after various steps of the chip sealing operation have been completed. These removable clear coverings protect the reflective portion of the marker from damage and can be removed to expose the reflective portions of the marker after the outer layer has become soiled or dirty.

The base portion 102 of the marker is configured to contact a surface and maintain the upright portion 104 of the marker generally perpendicular to the road surface and the base portion 102 of the marker. The base portion 102 has an adhesive portion 106 that allows the base portion 102 of the marker to be connected to a road surface. This adhesive 106 can be placed upon the marker 100 in a variety of ways. Typically, this adhesive has been pre-applied to the base portion of the marker and is covered with a material that prevents the adhesive from sticking to other materials. Prior to placement, this cover must be removed so as to allow the adhesive to contact the surface of the road and for the marker to be adhered thereto. In other embodiments, the marker 100 may not have a pre-applied material on its base but, rather, may require that an adhesive be placed upon the base portion 102 of the marker prior to placing the marker 100 upon a road surface.

Figure 2:
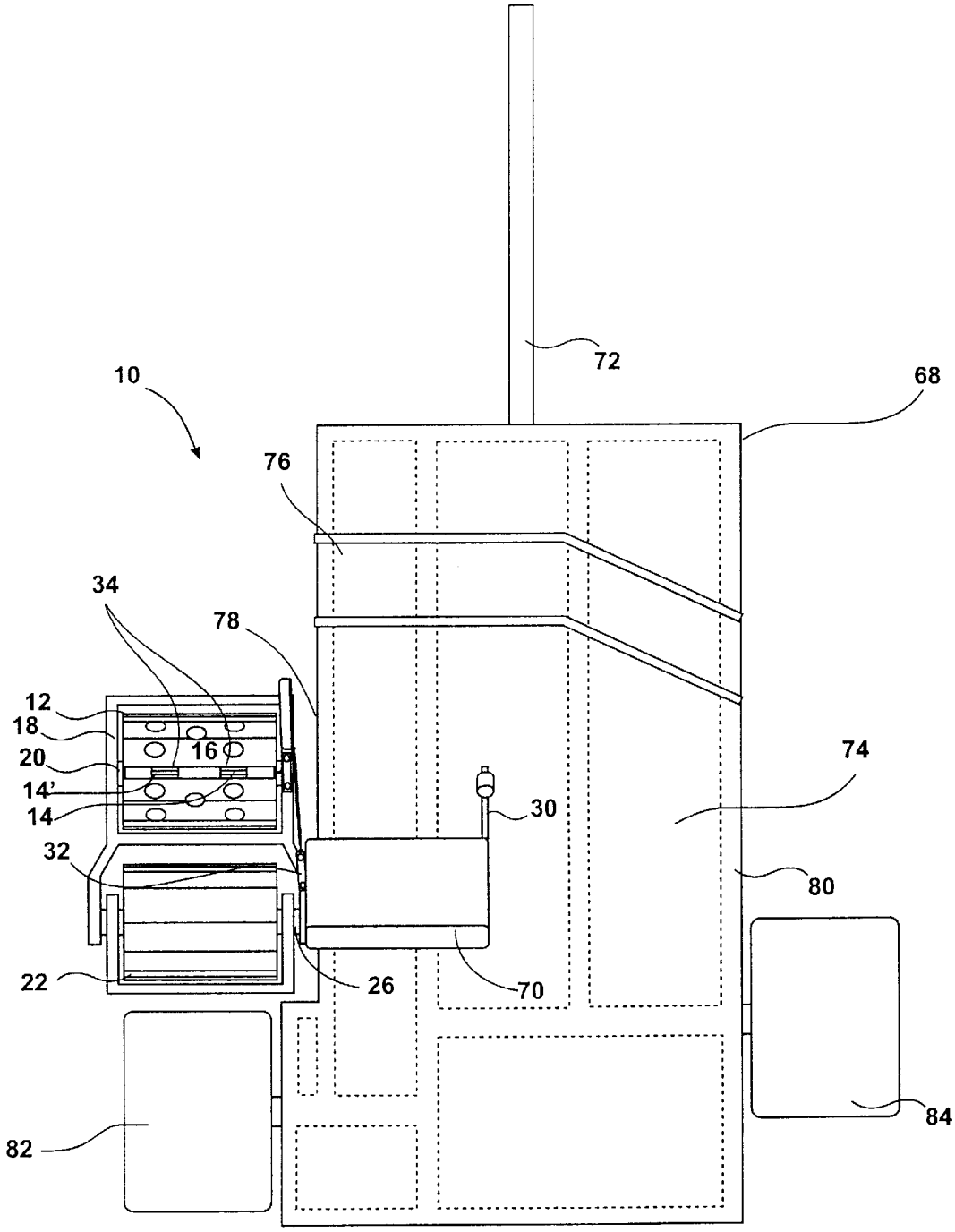
FIG. 2 is a top plan view of the preferred embodiment of the invention.

Referring now to FIGS. 2–7, the preferred embodiment of the present invention is shown. FIG. 2 shows a top plan view of the preferred embodiment of the present invention. The invention 10 is made up of an application wheel 12 having a generally cylindrical surface 16 defining a pair of adjustable apertures 14, 14'. This generally cylindrical surface 16 is covered with a material such as so called "hard-facing" which assists the application wheel 12 to spin and prevents the application wheel 12 from slipping and sliding on the road surface. The apertures 14, 14' are configured to receive the upright standing portion 104 of the marker within them.

In the preferred embodiment, the size of the apertures 14, 14' is adjustable so as to allow a variety of variously sized markers to be used. The apertures 14, 14' are ideally configured to place markers 100 in pairs upon a road surface with a space between the markers 100 that meets the requirements of the applicable traffic rules and regulations. The markers 100 are held within the apertures 14, 14' by a grasping device 34. The grasping device 34 is a moveable structure made of a semi-rigid material which has sufficient pliability so as to conform around a marker 100 and retain the marker 100 within the aperture 14, 14' until placement of the adhesive portion 106 of the marker upon a road surface. When the marker 100 has been placed the grasping device 34 must be sufficiently pliable so as to allow the marker to be released from within the aperture 14, 14'. A variety of materials and structures may be used for this design. In the preferred embodiment this is done with pieces of aluminum flashing that form a v-shape within the apertures. This flashing is held in place by fasteners that allow the grasping devices to be changed as needed. While this design and these materials are disclosed as part of the preferred embodiment it is to be distinctly understood that other materials or designs may also be used depending upon the necessities of the user and the financial resources available. It is to be understood that all materials and shapes which perform the functions of releasably holding a marker within the apertures as previously described are contemplated by this invention and disclosure.

The application wheel 12 is held within a frame 18 that allows for free rotation of the application wheel 12 about an axis 20. In order to further assist the markers 100 to be compressed against the road surface, a compression wheel 22 is located in the frame behind application wheel 12. The frame 18 is configured to allow the application wheel 12 to be alternatively disposed in a plane higher than the plane of the compression wheel 22 when the application wheel is in a loading position and in the same plane as the compression wheel 22 when the application wheel is in an application position. The frame 18 containing the application wheel 12 is pivotally connected to a pull along type trailer by a pivot rod 26. The pivot rod 26 is connected to a lever 30 which is configured to raise and lower the application wheel 12, and the compression wheel 22.

The pull along type trailer 68 is configured to be pulled by a motor vehicle such as an all-terrain vehicle some times called a "four wheeler." While this type of pulling machine is described it is to be understood that any device which is capable of pulling such a trailer may be used. In addition other devices including those that are self-propelled are also contemplated within this invention. The trailer 68 has a hitch 72 configured to be attached to a motor vehicle for pulling the device. The hitch 72 extends to a platform 74 which has a first side 78 and a second side 80. The trailer 68 is supported upon a first support wheel 82 and a second support wheel 84. The frame 18 is connected to the first side of the platform 78, although it is to be understood that the frame 18 and release lever 30 configuration disclosed could be configured to attach to either side of the trailer 68, depending upon the necessities of the user.

The connection between the trailer 68 and the frame 18 is provided by a pivot rod 26 and an adjustable attachment bracket 32. The attachment bracket 32 is connected to a release lever 26 that allows a user to move the application wheel 12 and frame 18 alternatively from a storage or travel position (shown in FIG. 5) to a loading position (shown in FIG. 6) to an application position (shown in FIG. 7). While in this embodiment a release lever 30 and pivot rod 26 are utilized to vary the elevation of the application wheel 12, it is to be distinctly understood that other devices or methods that perform this same function can also be utilized.

The platform has a seatback 70 and a storage rack 76 which are intended for the convenience of the user of the device. In addition other features of convenience such as a shield or cover may also be added. While in this embodiment these conveniences are shown, it is to be understood that these are provided merely for the convenience of the user and that the types of embodiments shown are intended to be illustrative and not limited to the descriptions set forth herein. The seatback 70 and the storage rack 76 provide a place for a user of the device to sit while that person loads road markers into the slots of the application wheel 12 and raises and lowers the application wheel 12 to place the markers 100 upon a road surface.

In use, the user of the device is seated upon the platform 74 behind the storage rack 76 with their back against the seatback 70. The application wheel 12 and frame 18 are held in a loading position (shown in FIG. 6.) The hitch 72 of the trailer 68 is connected to the pulling device that is pulls the device 10 forward at a desired rate of speed. The user is seated next to the application wheel 12 and the frame 18. The application wheel 12 is in the loading position shown in FIG. 6. The pulling device is equipped with a guidance locator which shows the user where the location of the markers will be in the future. When the guidance locator passes over a location where the marker 100 must be placed the user exposes the adhesive backing 106 of the marker and places the marker 100 into the apertures 14,14' of the application wheel 12. As the application wheel 12 approaches the location of where the marker 100 is to be placed, the user releases the application wheel 12 by first lifting and then pushing down on the release lever 30. This releases the application wheel 12 and puts the application wheel 12 into contact with a road surface (this position is called the application position and is shown in FIG. 7). Once the application wheel 12 has made contact with the road surface, the application wheel 12 will rotate, as the wheel rotates the adhesive portion 106 of the marker 100 contacts the road surface. When this occurs the marker 100 is pulled out of the apertures 14, 14' and remains upon the road surface. Once the marker 100 has been placed the release lever 30 can then be pulled to restore the application wheel 12 to the loading position (shown in FIG. 6).

In order to enhance the cohesion between the road surface and the marker a compression wheel passes over the marker 100 after it has been placed. In the preferred embodiment the marker 100 is compressed several times. First, after the marker 100 is applied to the surface of the road a compression wheel 22 rolls over the marker to compress the marker 100 against the road surface. After the compression wheel 22 has passed over the marker 100, the trailer first support wheel 82 is configured to further compress the markers 100 into the road surface. In order to facilitate this the trailer first support wheel 82 is configured to align with and pass over the markers 100 after placement upon the road surface. While in this preferred embodiment a compression wheel 22 per se is shown it is to be understood that such a device may be removed at the option of the user. The compressive functions of this compression wheel may also be achieved by the first trailer support wheel 82.

Figure 3:
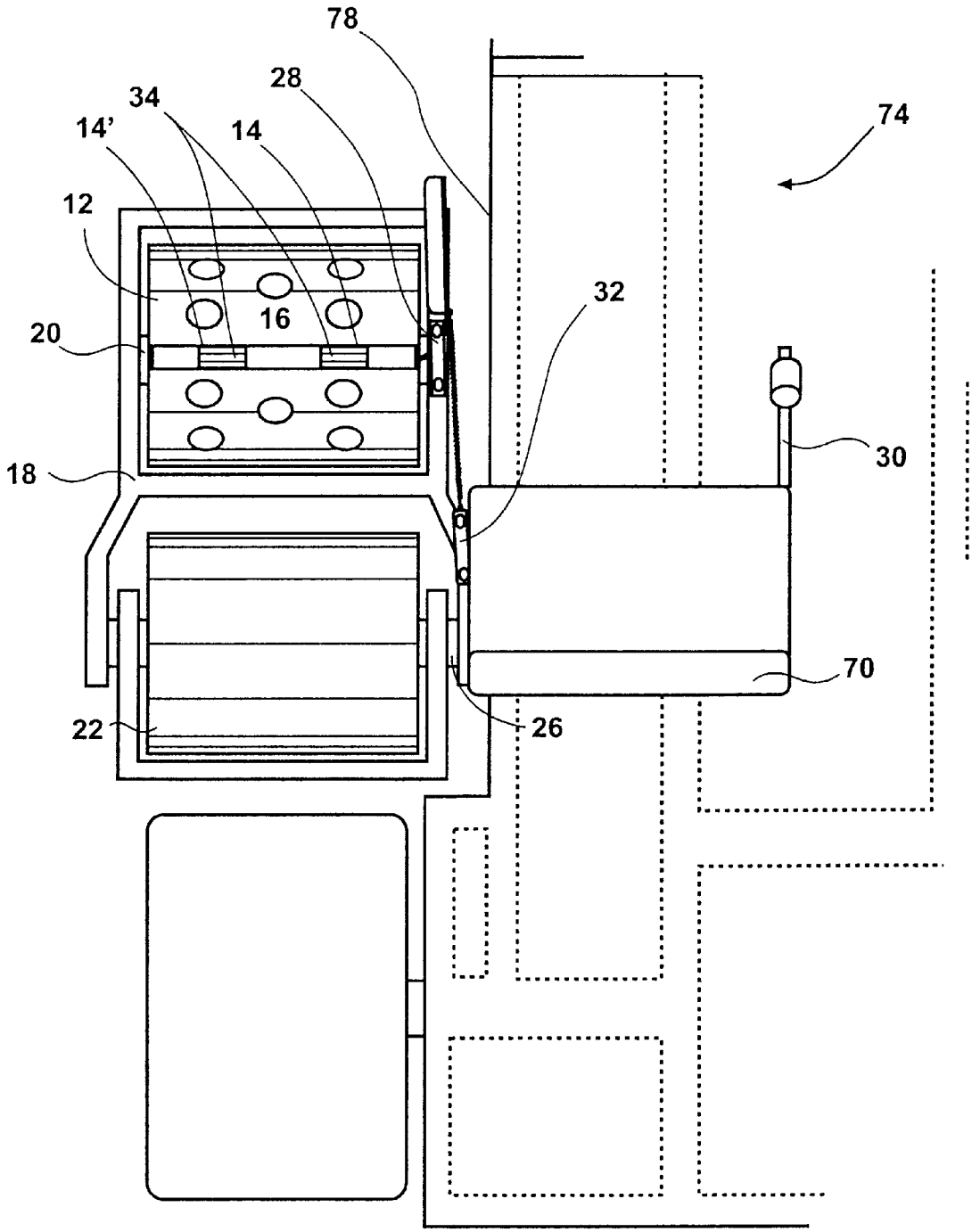
FIG. 3 is a detailed top plan view of a portion of the embodiment shown in FIG. 2.

Referring now to FIG. 3 a detailed close up view of the connection of the frame and the trailer is shown. The first side of the platform 78 has an adjustment bracket 32 and a pivot rod 26 that hold the frame 18, the application wheel 12 and the compression wheel 22 in a desired position. In addition, in this embodiment the application wheel 12 is held in a desired orientation and prevented from rotation by a catch latch 28 which is configured to engage a portion of the application wheel 12. A detailed top view of the catch latch 28 is shown in FIG. 4.

Figure 4:
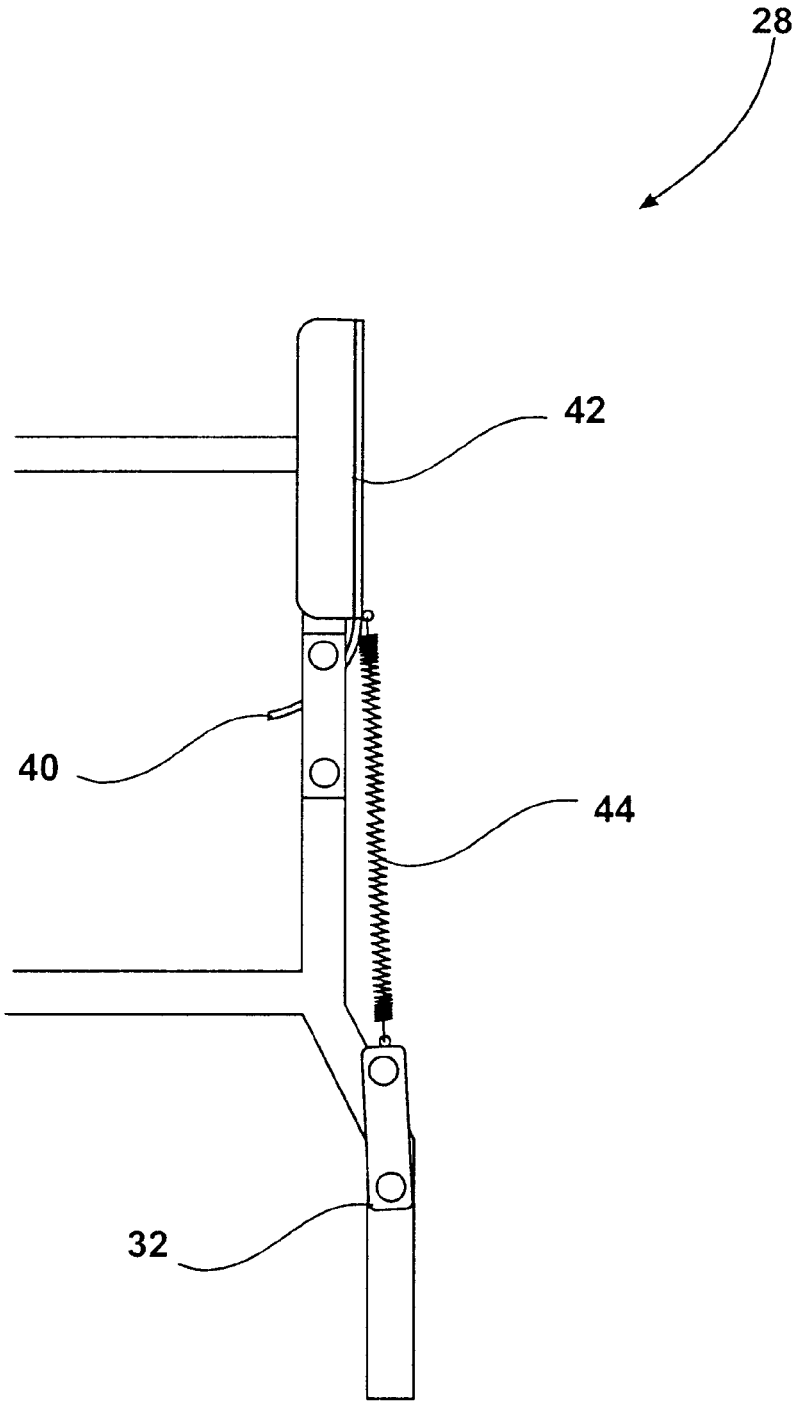
FIG. 4 is a detailed top plan view of the catch latch portion shown in FIG. 3.
Figure 5:
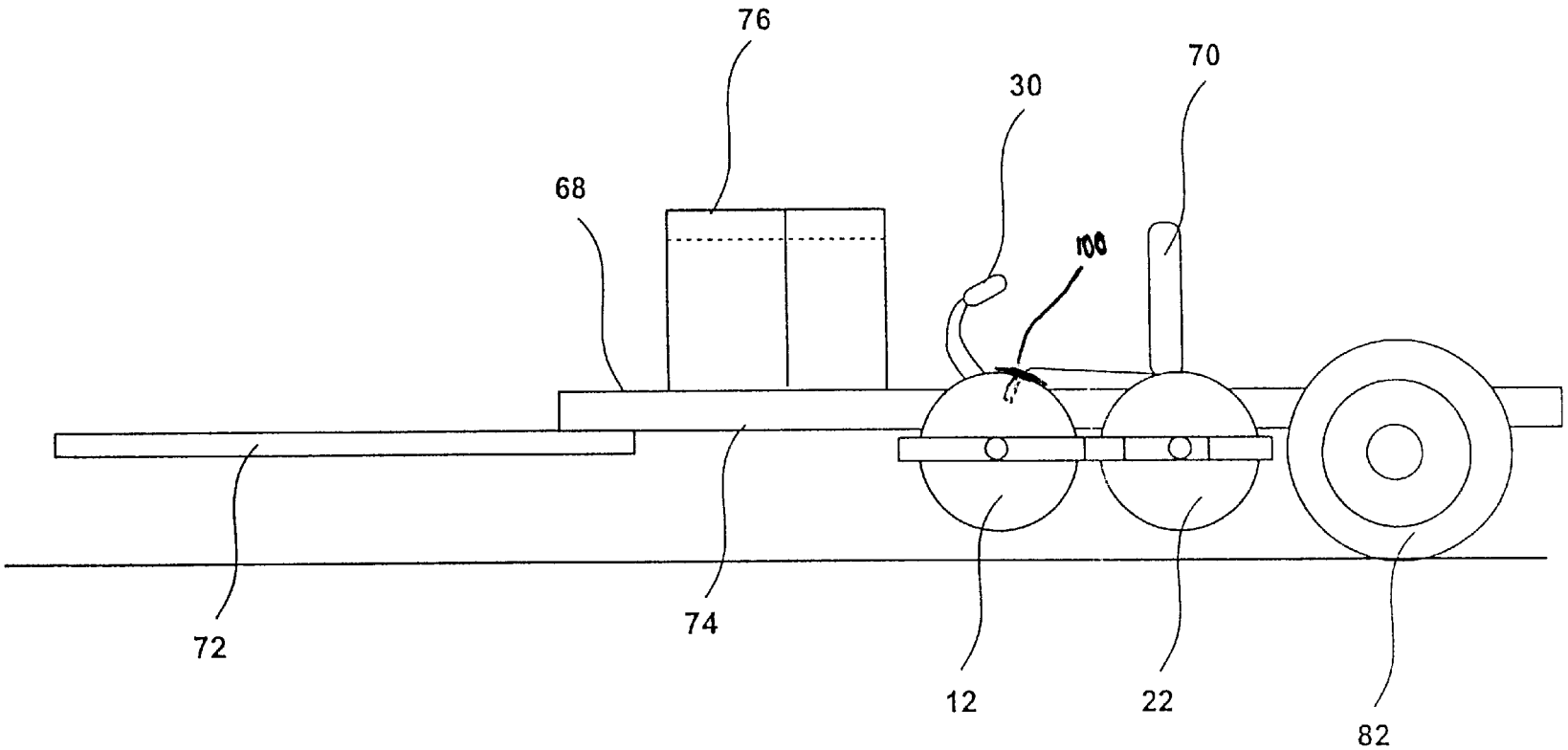
FIG. 5 is a side view of the preferred embodiment of the invention in a traveling or storage position.

FIG. 4 shows a detailed top view of the catch latch 28 apparatus. The catch latch apparatus 28 is comprised of a catch 40 that is configured to interact with a portion of the application wheel 12 to hold the application wheel 12 in an orientation where the apertures 14, 14' are facing upward toward the user. The catch 40 is connected to a handle 42 which is pushed toward the application wheel 12 to free catch 40 and allow the application wheel 12 to rotate. After the application wheel 12 has begun to roll, the spring 44 pulls the catch 40 and the handle 42 back into to their original positions. The catch 40 then engages a portion of the application wheel 12 and prevents the application wheel 12 from further rotation from the desired position. This feature facilitates use of the device as it ensures that the application wheel 12 self stabilizes into a position that allows the user to more easily place markers 100 within the application wheel 12.

The connection between the frame, application wheel, and the first side of the platform is accomplished by an adjustable connection bracket 32 and by a pivot rod 26. A top plan view of this portion of the device is shown in FIG. 3. The release lever 30, the adjustment bracket 32 and the pivot rod 26 work in conjunction to provide three positions for the frame 18 and application wheel 12 assembly. While these types of connections are shown in this preferred embodiment, it is to be understood that such connection is merely illustrative and not limiting.

The pivot rod 26 is attached to a portion of the frame 18 and provides a fixed point upon which the frame 18 and the application wheel 12 can pivot. The release lever 30 controls the movement of the attachment bracket 32 from a travel or storage position shown in FIG. 5, where both the application wheel 12 and the compression wheel 22 are raised to a loading position where the application wheel 12 is not in contact with a road surface but the compression wheel 22 is in contact with the road surface. This loading position is shown in FIG. 6.

Figure 6:
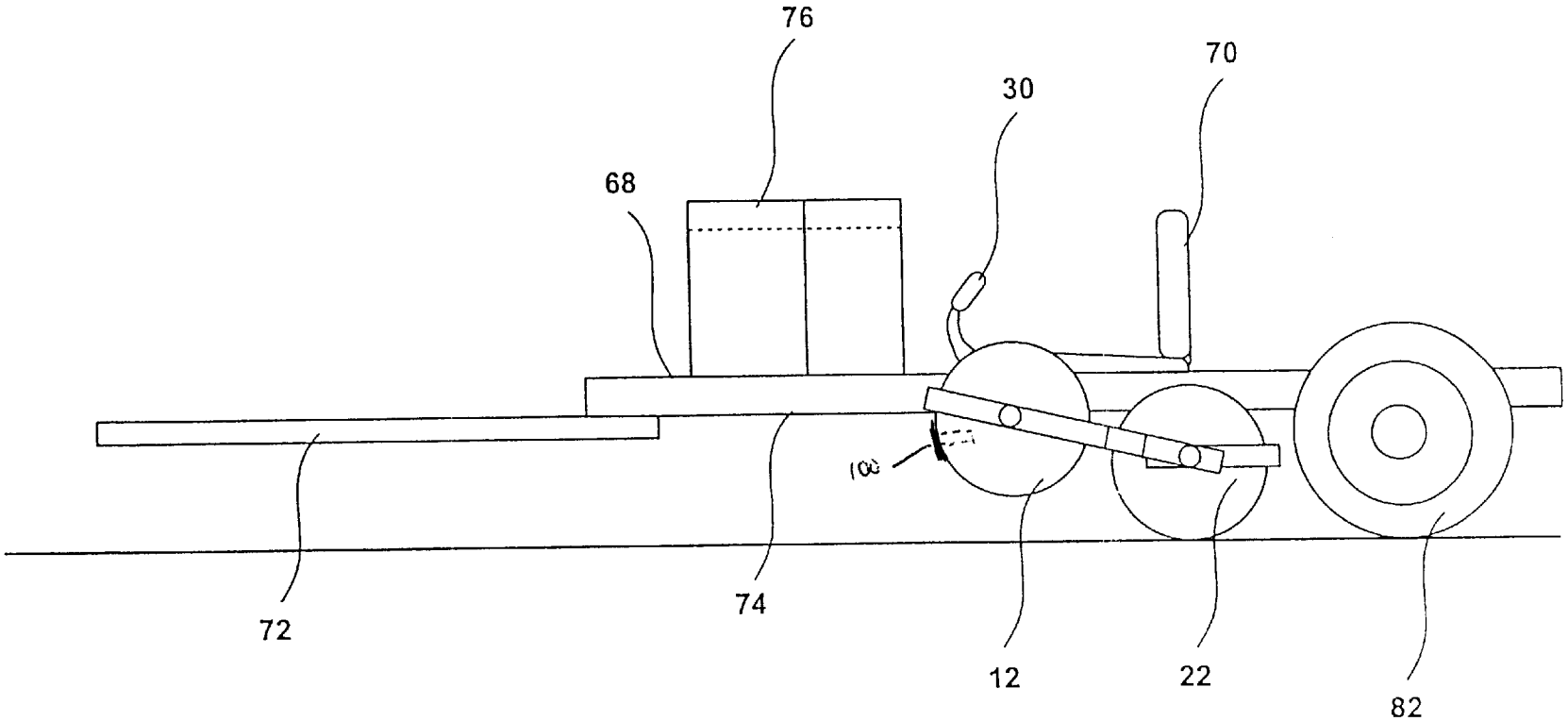
FIG. 6 is a side view of the preferred embodiment of the invention when the compression wheel is in place upon a road surface.
Figure 7:
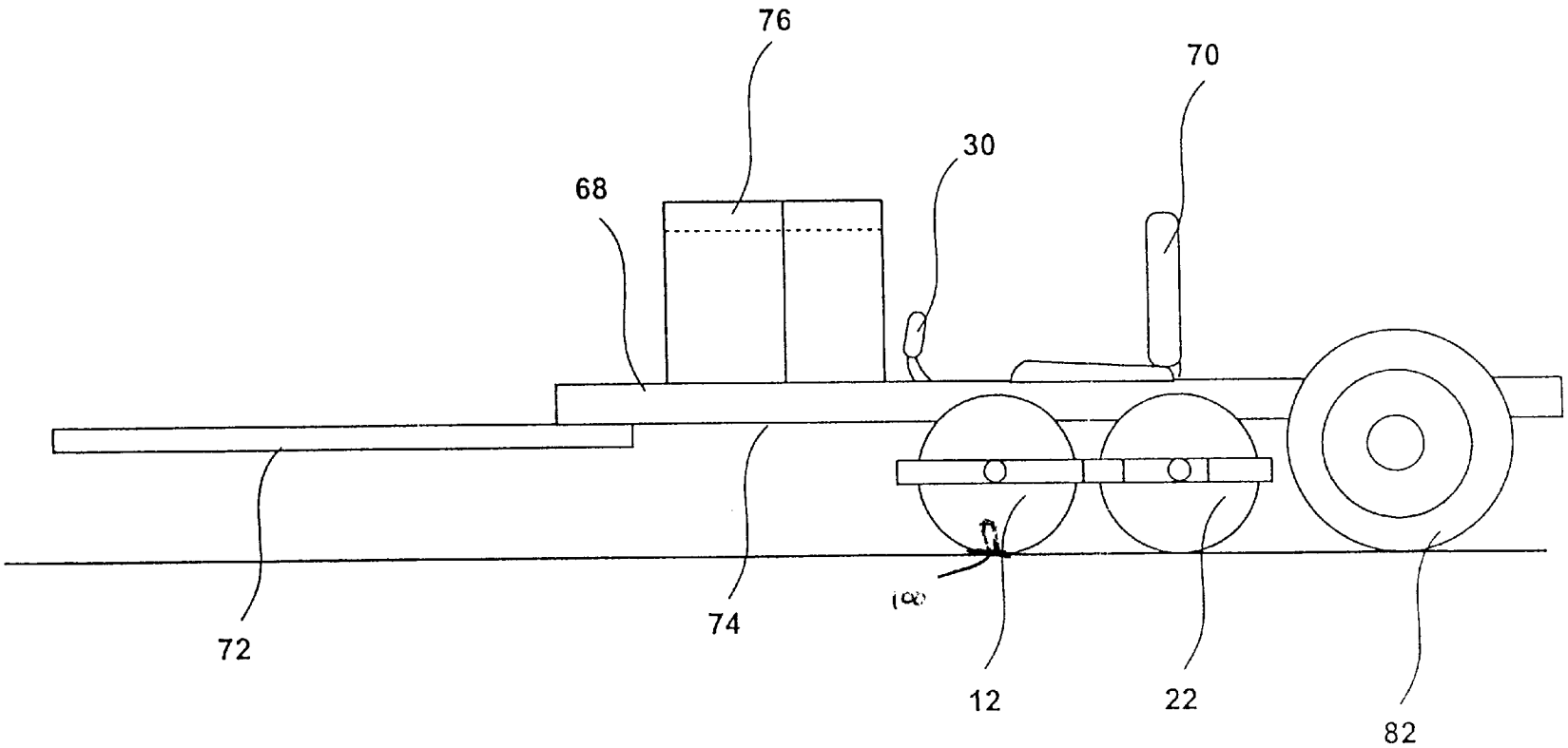
FIG. 7 is a side view of the preferred embodiment of the present invention when the compression wheel and the application wheel are both in contact with a road surface.

From this loading position shown in FIG. 6, a user loads a marker 100 for placement within the apertures 14,14', releases the catch latch 28 and lowers the application wheel 12 on to the road surface in an application position. This application position is shown in FIG. 7.

From this application position, the markers 100 are placed upon the road surface. Once the marker 100 has been placed upon the road surface the application wheel 12 can be raised and placed into the loading position to received another marker 100.

The present invention provides a device and illustrates a method for placing road markers that is more cost effective than other methods known in the prior art. This device and method also can be purchased and achieved in a way that is significantly less expensive than other marker placement devices that are available in the prior art. This device also provides a device that allows road markers to be placed in varying and complex positions.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A device for placing individual road markers upon a road surface, each of said road markers having an adhesive base portion and a reflective standing portion, said device comprised of:

a hitch for connecting said device to a pulling means, said pulling means configured to pull said device along a road surface;

a platform connected to said hitch said platform having a first side and a second side, a generally cylindrically shaped application wheel rotatably connected to an axle which is held within a frame, said frame releasably adjustably connected to said platform, said application wheel having a generally cylindrical surface, said surface defining therein at least one aperture configured to receive a portion of one of said markers, said application wheel configured to engage and hold a portion of one of said road markers and to deposit said marker in a desired location along a road surface;

an application wheel control means configured to control the rotational movement of said application wheel, a first trailer support wheel, configured for rolling contract with a road surface said first trailer support wheel connected to said first side of said platform by a first axle means, said first trailer support wheel located behind said application wheel mechanism and configured to press said marker into a road surface after said marker is deposited in said desired position by said application wheel; and a second trailer support wheel connected to said second side of said platform by a second axle means, said second wheel configured for rolling contact with a road surface and a compression wheel rotatable connected to said frame, said compression wheel configured to follow behind said application wheel and to compress said marker against said road surface.

2. The device of claim 1 wherein said platform further comprises an adjustment attachment bracket configured for attachment with said application wheel mechanism and configured to allow said application wheel mechanism to be attached to said platform in a variety of positions.

3. The device of claim 1 wherein said apertures of said application wheel are configured to be adjusted to accommodate a variety of different sized markers depending upon the necessities of a user.

4. The device of claim 1 further comprising a release lever pivotally attached to a portion of said platform and configured to release said application wheel mechanism so as to allow said application wheel mechanism to contact a road surface, rotate about said application wheel axis and deposit one of said markers in a desired location along said road surface.

5. The device of claim 1 wherein a portion of said application wheel mechanism control means comprises a catch latch configured to correspond with a portion of said application wheel said catch latch and said application wheel configured so as to prevent rotation of said application wheel.

6. The device of claim 1 wherein said application wheel surface defines at least two adjustable apertures each configured to engage a portion of at least two road surface markers therein.

7. The device of claim 1 wherein said first trailer support wheel is configured to be positioned behind said application wheel mechanism so that said first trailer support wheel impresses said road marker into said road surface after said road marker has been placed in a desired location upon said road surface by said application wheel.

8. The device of claim 1 wherein said device further comprises a storage rack attached to said platform said storage rack configured to store material.

9. The device of claim 1 wherein said device further comprises a seatback attached to said top of said platform said seatback configured to support a user of said device when said user is seated upon said platform.

10. A device for placing individual road markers upon a road surface, each of said road markers having an adhesive base portion and a standing portion, said device comprised of:

a hitch configured for connection to a pulling means, said pulling means configured to pull said device along a road surface;

a platform connected to said hitch, said platform having a first side and a second side, a generally cylindrically shaped application wheel rotatably connected to an axle, said application wheel and said axle held within said frame, said frame releasably adjustably connected to said platform by an adjustment attachment bracket and a pivot rod, said application wheel having a generally cylindrical surface, said surface defining therein at least one aperture adjustably configured to receive a portion of one of said markers, said application wheel configured to engage and hold a portion of one of said road markers and to deposit said marker in a desired location along a road surface;

a catch latch, said catch latch configured to interact with said application wheel to prevent rotation of said application wheel, a release lever connected to said platform and to said frame, said release lever configured to control the movement of said application wheel from a first position wherein said application wheel is not in contact with a road surface to a second position wherein said application wheel is in contact with said road surface;

a compression wheel configured for rolling contract with a road surface said compression wheel configured to compress said marker after said marker has been placed by said application wheel;

a first trailer support wheel configured to support said platform, a second trailer support wheel configured to support said platform, a seatback configured to support an operator when said operator is seated upon said platform; and a storage rack configured to storage rack said operator when said operator is seated upon said platform.

* * * * *